United States Patent [19]

Nagle

[11] 3,999,822

[45] Dec. 28, 1976

[54] CABINET TABLE

[75] Inventor: Carol A. Nagle, Garnerville, N.Y.

[73] Assignee: Lawrence Peska Associates, Inc., New York, N.Y. ; a part interest

[22] Filed: Feb. 6, 1976

[21] Appl. No.: 655,743

[52] U.S. Cl. ..... 312/250; 312/305; 312/317 R; 312/329

[51] Int. Cl.[2] ..... A47B 91/00; A47B 88/00

[58] Field of Search ..... 312/241, 255, 281, 282, 312/300, 314, 317, 326, 327, 328, 329; 108/90, 66, 76, 102, 103; 248/188.5 F

[56] References Cited

UNITED STATES PATENTS

| | | | |
|---|---|---|---|
| 1,221,498 | 4/1917 | Zerse | 312/282 |
| 1,285,881 | 11/1918 | Zaun | 312/281 |
| 1,524,767 | 2/1925 | Vandervoort | 108/76 |
| 3,592,520 | 7/1971 | Marino | 108/103 |
| 3,879,084 | 4/1975 | Jones | 248/188.5 |

FOREIGN PATENTS OR APPLICATIONS

| | | | |
|---|---|---|---|
| 808,620 | 7/1951 | Germany | 312/281 |

*Primary Examiner*—Paul R. Gilliam
*Assistant Examiner*—V. Sakran
*Attorney, Agent, or Firm*—Erwin S. Teltscher

[57] ABSTRACT

A cabinet table includes a center chest which has a pair of substantially vertical sidewalls, a table top mounted on the chest which has a portion overhanging at least one of the side walls and a substantially semi-circular top plate which is pivotably attachable to the support plate, and movable from a retracted position between the portion of the table top overhanging one of the side walls and the support plate of the bracket member to an extended position displaced by about 180° from the retracted position. The top surfaces of the portion overhanging at least one of the side walls and the semi-circular top plate are substantially defined by a plane in that extended position of the top plate.

2 Claims, 6 Drawing Figures

CABINET TABLE

BACKGROUND OF THE INVENTION

1. Field of the Invention

The field of the invention relates to a cabinet table having an extendable top.

2. Description of the Prior Art

Foldable tables having an extended top are known; tables of the aforesaid type are usually provided with a slidable and extensible top. In the event the material of the table, for example, wood, warps due to moisture absorption or any other causes, the required sliding action may become difficult to perform, or even inoperative. Means have therefore been sought to devise a table having an extensible top which would not be subject to the aforesaid difficulties.

SUMMARY OF THE INVENTION

It is therefore, an object of my present invention to obviate the aforesaid difficulties by providing a table having an extensible top wherein the extensible top is pivotable rather than slidable. I attain the aforesaid object by providing a center chest which has a pair of substantially vertical sidewalls, a table top mounted on the chest which has a portion overhanging at least one of the sidewalls, the portion having a first top surface and a substantially semi-circular top plate which has a second surface and is pivotably attached to the support plate.

The semi-circular top plate is movable from a retracted position between the portion of the table top overhanging one of the sidewalls and the support plate of the bracket member to an extended position displaced by about 180° from the retracted position. The first and second top surfaces are substantially defined by a plane in the extended position. The cabinet table additionally includes a leg attached to the top plate, wherein the leg includes a bottom portion which has a floor-rollable wheel attached thereto, and a top portion which is partially slidable into the bottom portion. Upon depression of the top plate, the top portion of the leg is made to slide into the bottom portion and causes the top plate to then be pivotably slidable in between the portion of the table top and the support plate.

The support plate is additionally formed with an arcuate slot for receiving the leg attached to the top plate in the retracted position of the latter.

The top portion of the leg is formed with first and second openings, respectively. A spring is interposed between the top and bottom portion of the leg and yieldably resistant pushbutton means are at least partially disposed in the second opening. Upon depression of the top portion into the bottom portion of the leg, the pushbutton means are at least partially slidable into the first opening, for preventing any further motion of the top portion with respect to the bottom portion of the leg.

The center chest has preferably a front wall, and includes a plurality of extensible drawers.

BRIEF DESCRIPTION OF THE DRAWING

My invention will be better understood with respect to the accompanying drawing in which.

DESCRIPTION OF THE PREFERRED EMBODIMENT

Figure 1:
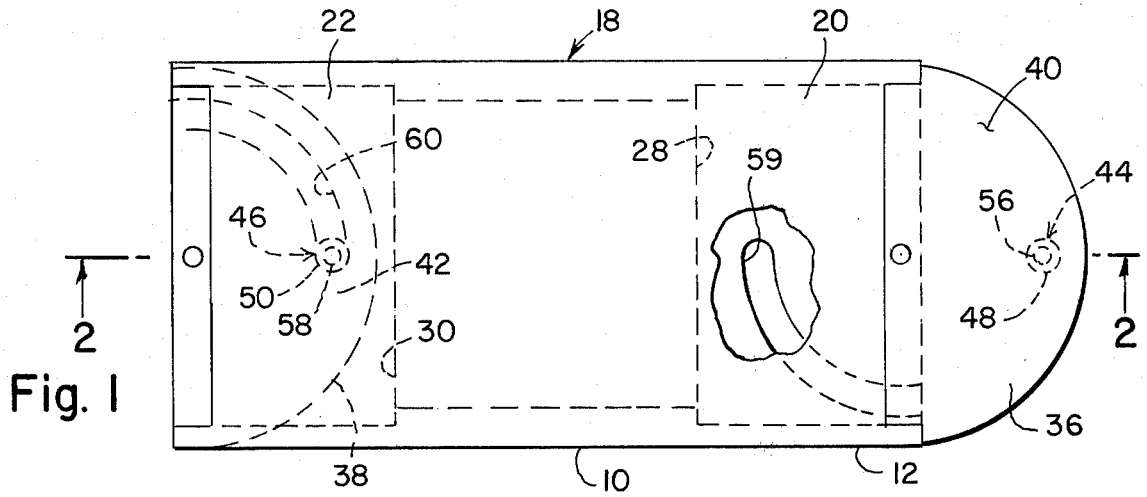
FIG. 1 shows a cabinet table, according to my invention, with a table top and one top plate in an extended position, and another top plate in a retracted portion.
Figure 2:
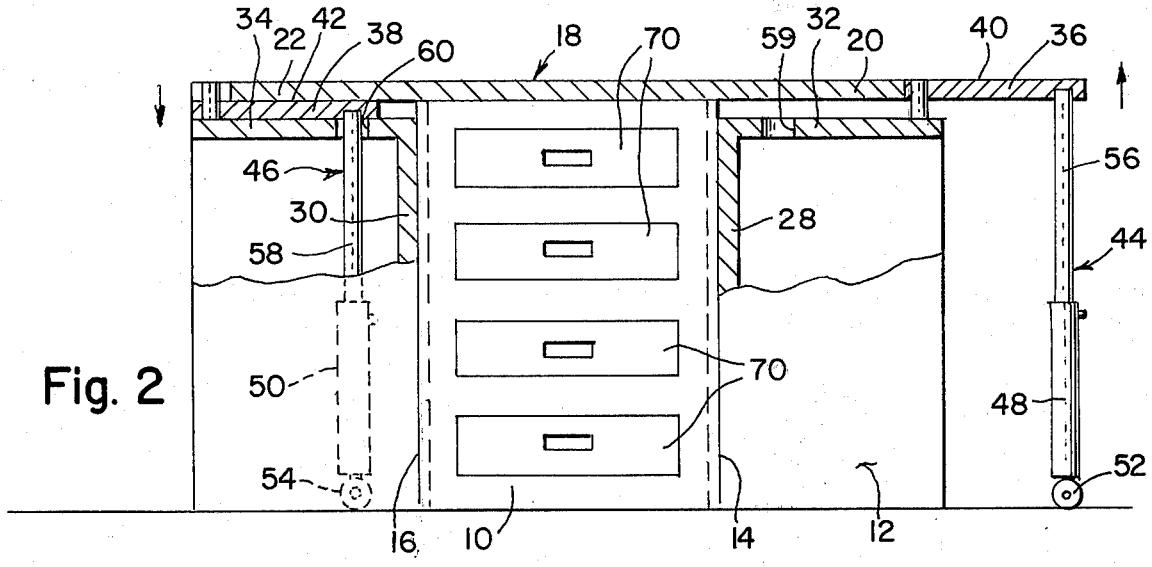
FIG. 2 shows an elevational view in part cross-section of the cabinet table.
Figure 3:
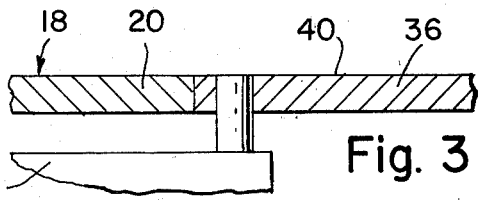
FIG. 3 shows a detail in part cross-section of the table top, and a top plate in an extended position.
Figure 4:
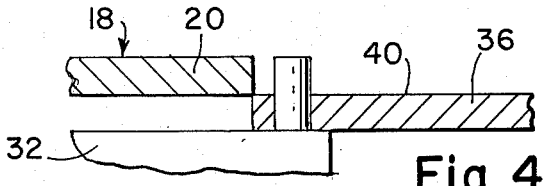
FIG. 4 corresponds to FIG. 3, but with the top plate in a depressed position.
Figure 5:
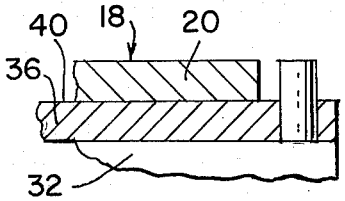
FIG. 5 corresponds to FIG. 3, but with the top plate in the retracted position.
Figure 6:
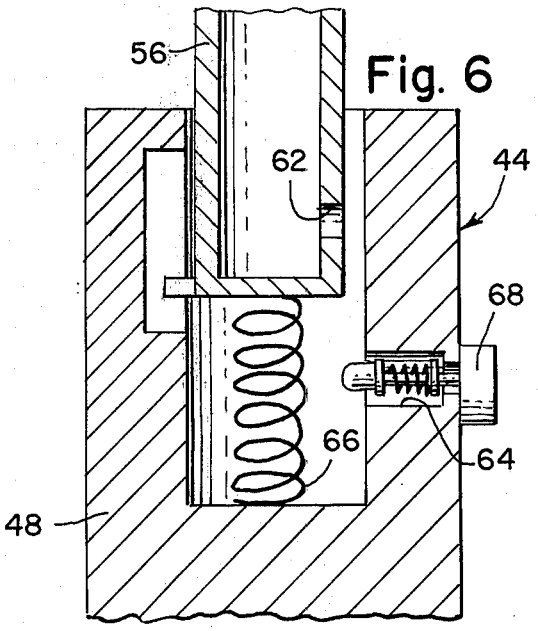
FIG. 6 is a detail showing the manner of attachment of the top and bottom portions of one of the legs of the cabinet.

Referring now to the drawing, a center chest 10 will be seen to have a pair of substantially vertical sidewalls 14 and 16, and a table top 18 mounted on the chest 10. Portions 20 and 22 are overhanging the sidewalls 14 and 16 respectively. Bracket members 28 and 30 are attached to the sidewalls 14 and 16 respectively, and each bracket is formed with a horizontal support plate 32 and 34 respectively. Each support plate is substantially coextensive with, disposed below, and spaced in a substantially parallel manner from the respective portions 20 and 22. Substantially semi-circular top plates 36 and 38 are pivotable attachable to the support plates 32 and 34 respectively. Each top plate is movable from a retracted position 20 (or 22) of the table top 18 overhanging the sidewall 14 (or 16) and the support plate 32 (or 34) of the bracket member 28 (or 30) to an extended position displaced by about 180° from the retracted position. The portion 20 (or 22) overhanging the sidewall 14 (or 16) of the table top 18 has a top surface 20 (or 22), and each semi-circular top plate 36 (or 38) has a top surface 40 (or 42). In the extended position of each top plate the first and second top surfaces are substantially defined by the plane.

The cabinet table includes a leg 44 (or 46) attached to the top plate 36 (or 38). The leg 44 (or 46) includes a bottom portion 48 (or 50) which has a floor-rollable wheel 52 (or 54) attached thereto and a top-portion 56 (or 58) partially slidable into the bottom portion 48 (or 50). Upon depression of the top plate 36 (or 38) the top portion 56 (or 58) of the leg 44 (or 46) is made to slide into the bottom portion 48 (or 50) so that the top plate 36 (or 38) is pivotably slidable between the portion 20 (or 22) of the table top 18, and the support plate 32 (or 34).

The support plates 32 and 34 are formed with respective arcuate slots 59 and 60 for receiving the legs 44 and 46 attached to the top plates 36 and 38, respectively, in the retracted position of the legs 44 and 46.

The top portion 56 (or 58) and the bottom portion 48 (or 50) of the leg 44 (or 46) are formed with first and second openings 62 and 64 respectively. A spring 66 is interposed between each top and bottom portion of the leg and yieldably resistant pushbutton means 68 are at least partially disposed in the second opening 64. Upon depression of the top portion 56 (or 58) into the bottom portion 48 (or 50) of the leg 44 (or 46), the pushbutton means 68 is at least partially slidable into the first opening 62 for preventing any further motion of the top portion 56 (or 58) with respect to the bottom portion 48 (or 50) of the leg 44 (or 46). The center chest 10 has a front wall 12 and includes a plurality of extensible drawers 70.

Although the invention has been described with respect to a preferred form thereof, it is to be understood that it is not to be so limited since changes can be made therein which are within the full intended scope of this invention as defined by the appended claims.

What is claimed is:

1. A cabinet table comprising:

a center chest having a pair of substantially vertical sidewalls;

a table top mounted on said chest having at least one portion overhanging at least one of said sidewalls, said portion having a first top-surface;

a bracket member attached to said one of said sidewalls, said bracket member having a horizontal support plate being substantially coextensive with, disposed below, and spaced in a substantially parallel manner from said portion;

a substantially semicircular top-plate having a second top surface, being pivotably attachable to said support plate and movable from a retracted position between the portion of said tabletop overhanging one of said sidewalls and the support plate of said bracket member to an extended position displaced by about 180 degrees from said retracted position, wherein said first and second top surfaces are substantially defined by a plane in said extended position, a leg being attached to said top plate, wherein said support plate is formed with an arcuate slot for receiving said leg attached to said top plate in the retracted position of the latter, wherein said leg comprises a bottom portion having a floor-rollable wheel attached thereto and a top portion partially slidable into said bottom portion and wherein said top and bottom portions of said leg are formed with first and second openings, respectively, and a spring interposed between said top and bottom portions of said leg and yieldably resistant pushbutton means at least partially disposed in said second opening, whereby, upon depression of said top-plate said top portion of said leg is made to slide into said bottom portion causing said top plate to be pivotably slidable in between said portion of said table top and said support plate, and upon depression of said top portion into said bottom portion of said leg said pushbutton means is at least partially slidable into said first opening for preventing any further motion of said top-portion with respect to said bottom portion of said leg.

2. A cabinet table according to claim 1, wherein said center chest has a front wall and includes a plurality of extensible drawers.

* * * * *